US009689403B2

(12) United States Patent
Fang et al.

(10) Patent No.: US 9,689,403 B2
(45) Date of Patent: Jun. 27, 2017

(54) PUMP HAVING SELECTABLE OUTLETS

(71) Applicant: Johnson Electric S.A., Murten (CH)

(72) Inventors: Chuanhui Fang, Hong Kong (CN); Feng Liu, Shenzhen (CN); Feng Xue, Shenzhen (CN); Chuanjiang Guo, Shenzhen (CN); Liang Guan, Shenzhen (CN); Serge Pesetsky, Shenzhen (CN)

(73) Assignee: Johnson Electric S.A., Murten (CH)

( * ) Notice: Subject to any disclaimer, the term of this patent is extended or adjusted under 35 U.S.C. 154(b) by 512 days.

(21) Appl. No.: 14/222,409

(22) Filed: Mar. 21, 2014

(65) Prior Publication Data

US 2014/0286747 A1 Sep. 25, 2014

(30) Foreign Application Priority Data

Mar. 22, 2013 (CN) ..... 2013 1 0093591

(51) Int. Cl.
*F04D 29/48* (2006.01)
*F04D 29/42* (2006.01)
*F04D 15/00* (2006.01)

(52) U.S. Cl.
CPC ..... *F04D 29/4293* (2013.01); *F04D 15/0016* (2013.01); *F04D 29/486* (2013.01); *Y10S 415/911* (2013.01)

(58) Field of Classification Search
CPC ..... F04D 15/0016; F04D 29/4293; F04D 29/486; Y10S 415/911
See application file for complete search history.

(56) References Cited

U.S. PATENT DOCUMENTS

| | | | | |
|---|---|---|---|---|
| 3,807,426 A * | 4/1974 | Henes | F15C 3/04 137/100 |
| 4,824,332 A * | 4/1989 | Perkins | F04D 15/0016 415/146 |
| 4,900,235 A * | 2/1990 | Perkins | F04D 15/0016 415/146 |
| 2012/0114473 A1 | 5/2012 | Badafem | |
| 2014/0166109 A1* | 6/2014 | Takai | B60S 1/481 137/1 |

FOREIGN PATENT DOCUMENTS

| | | | |
|---|---|---|---|
| EP | 0 460 399 A2 | 12/1991 | |
| GB | 2199080 A * | 6/1988 | B60S 1/481 |
| GB | 2 320 061 A | 10/1998 | |
| JP | H 05-245093 A | 9/1993 | |
| JP | H 10-141295 A | 5/1998 | |
| JP | WO 2012046264 A1 * | 4/2012 | B60S 1/481 |

* cited by examiner

*Primary Examiner* — Audrey K Bradley
(74) *Attorney, Agent, or Firm* — Muncy, Geissler, Olds & Lowe, P.C.

(57) ABSTRACT

A liquid pump (10) comprises an impeller (60) housed in an impeller chamber (22) having an axial inlet (26) and a plurality of centrifugal passages (23, 24) communicating with a plurality of outlets (35*a*, 35*b*) through a valve (80). The rotation of the impeller (60) pumps the liquid into one of the centrifugal passages (23, 24) and elastically deforms the valve (80) that controls through which outlet (35*a*, 35*b*) the liquid is pumped out of the pump (10).

17 Claims, 10 Drawing Sheets

PUMP HAVING SELECTABLE OUTLETS

CROSS REFERENCE TO RELATED APPLICATION(S)

This application claims the benefit of Chinese patent application serial no. 201310093591.7, filed on Mar. 22, 2013. The entire content of the aforementioned patent application is hereby incorporated by reference for all purposes.

BACKGROUND

Liquid pumps are used in many different types of machines and appliances, such as dishwashers and washing machines. In some applications, different functions of the machine or appliance may require liquid to be pumped through a plurality of different paths.

For example, many modern washing machines have both a water drainage function and a water recirculation function. During operation, water within the washing chamber of the washing machine may enter either a recirculation path to be re-injected into the washing chamber through a nozzle, or a drainage path to exit the machine. In order to achieve the water drainage and water circulation functions, the machine may contain a water pump having a single inlet connected to the washing chamber, an outlet connected to a drainage path, and an outlet connected to a circulation path. Traditionally, a pair of solenoid valves is used to alternatively control the opening of the two outlets and determine into which path the water will flow.

Thus, it is desirable for a pump to have selectable outlets corresponding to the different paths, such that a single pump may be used to pump liquid through different paths. However, the use of two solenoid valves and their associated control circuitry, one for each outlet, increases the costs of the pump.

Accordingly, there exists a need for a lower cost pump apparatus having selectable outlets.

SUMMARY

Some embodiments are directed at a liquid pump having selectable outlets. A motor driving an impeller is used to pump liquid that enters the pump through an inlet to one of the plurality of outlets. A flexible valve is used to direct the liquid in the pump to a desired outlet. In some embodiments, the flexible valve is positioned between a first and second outlet chamber, wherein a difference in the amount of water in the first and second outlet chambers causes the flexible valve to deform and seal one of the outlets. In some embodiments, the amount of water in each outlet chamber is based upon a direction of rotation of the motor and impeller. For example, impeller rotating in a first direction pumps liquid from the impeller chamber substantially to the first outlet chamber, causing the valve to elastically deform in a first direction, thereby controlling a flow of liquid through the first outlet.

BRIEF DESCRIPTION OF THE DRAWINGS

The drawings illustrate the design and utility of embodiments, in which similar elements are referred to by common reference numerals. These drawings are not necessarily drawn to scale. In order to better appreciate how the above-recited and other advantages and objects are obtained, a more particular description of the embodiments will be rendered which are illustrated in the accompanying drawings. These drawings depict only exemplary embodiments and are not therefore to be considered limiting of the scope of the claims.

DETAILED DESCRIPTION

Figure 1A:
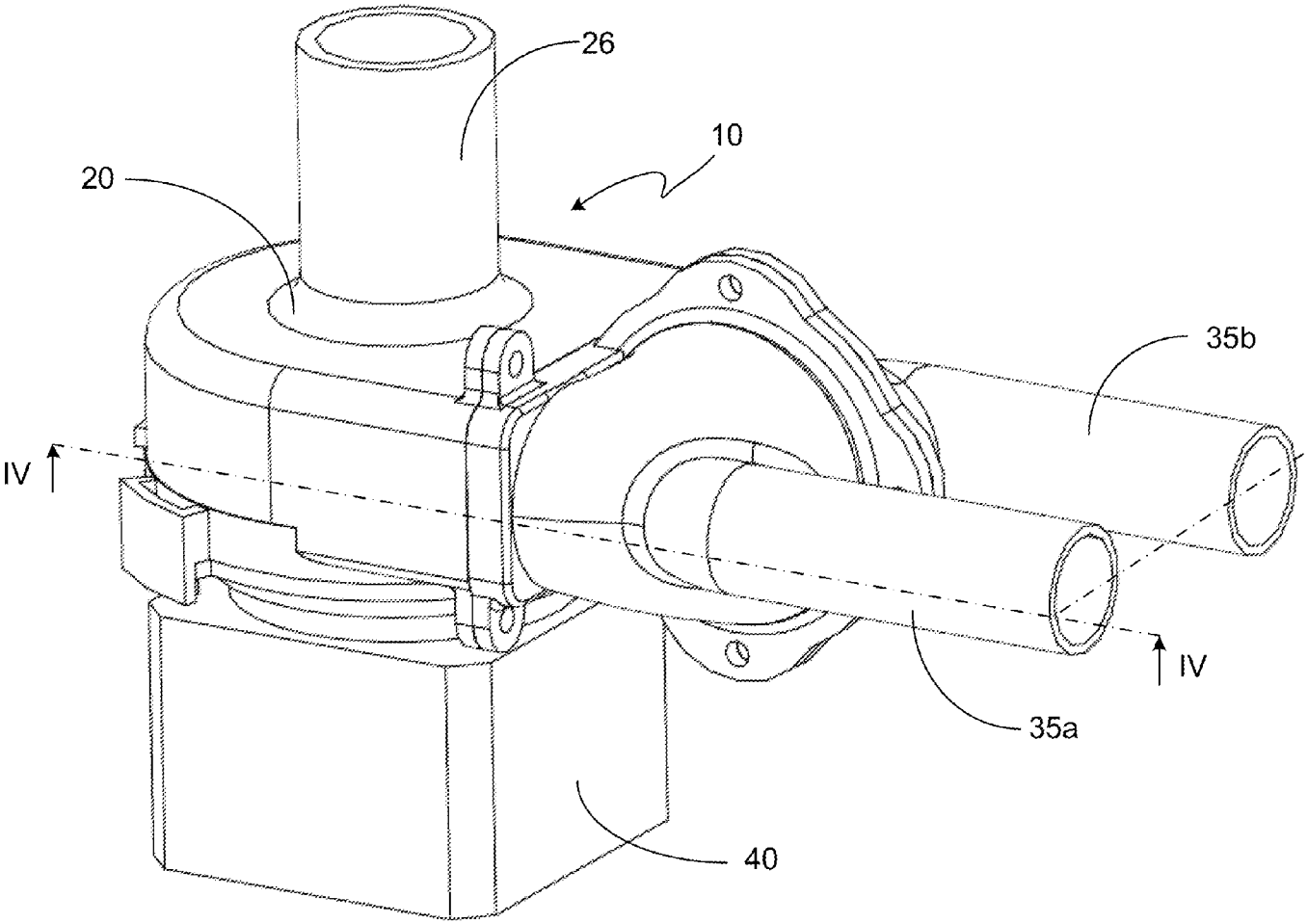
FIGS. 1A, 1B, and 1C illustrate perspective views of a pump in accordance with some embodiments.

Various features are described hereinafter with reference to the figures. It shall be noted that the figures are not drawn to scale, and that the elements of similar structures or functions are represented by like reference numerals throughout the figures. It shall also be noted that the figures are only intended to facilitate the description of the features for illustration and explanation purposes, unless otherwise specifically recited in one or more specific embodiments or claimed in one or more specific claims. The drawings figures and various embodiments described herein are not intended as an exhaustive illustration or description of various other embodiments or as a limitation on the scope of the claims or the scope of some other embodiments that are apparent to one of ordinary skills in the art in view of the embodiments described in the Application. In addition, an illustrated embodiment need not have all the aspects or advantages shown.

An aspect or an advantage described in conjunction with a particular embodiment is not necessarily limited to that embodiment and may be practiced in any other embodiments, even if not so illustrated, or if not explicitly described. Also, reference throughout this specification to "some embodiments" or "other embodiments" means that a particular feature, structure, material, process, or characteristic described in connection with the embodiments is included in at least one embodiment. Thus, the appearances of the phrase "in some embodiments", "in one or more embodiments", or "in other embodiments" in various places throughout this specification are not necessarily referring to the same embodiment or embodiments.

Some embodiments are directed at a liquid pump having selectable outlets. In accordance with some embodiments, the liquid pump comprises an inlet and a plurality of outlets. A motor driving an impeller is used to pump liquid that enters the pump through the inlet to one of the plurality of outlets. A flexible valve is used to direct liquid in the pump to a desired outlet of the plurality of outlets. In some embodiments, the position of the valve, as thus the outlet through which liquid is pumped, is determined by a direction of rotation of the motor.

While the illustrated embodiments, for ease of explanation, primarily refer to water pumps for use in a washing machine, it is understood that some embodiments may be applied to different types of machines and appliances (e.g., dishwashers, other home appliances, etc.), and/or may be used to pump liquids other than water.

Figure 1B:
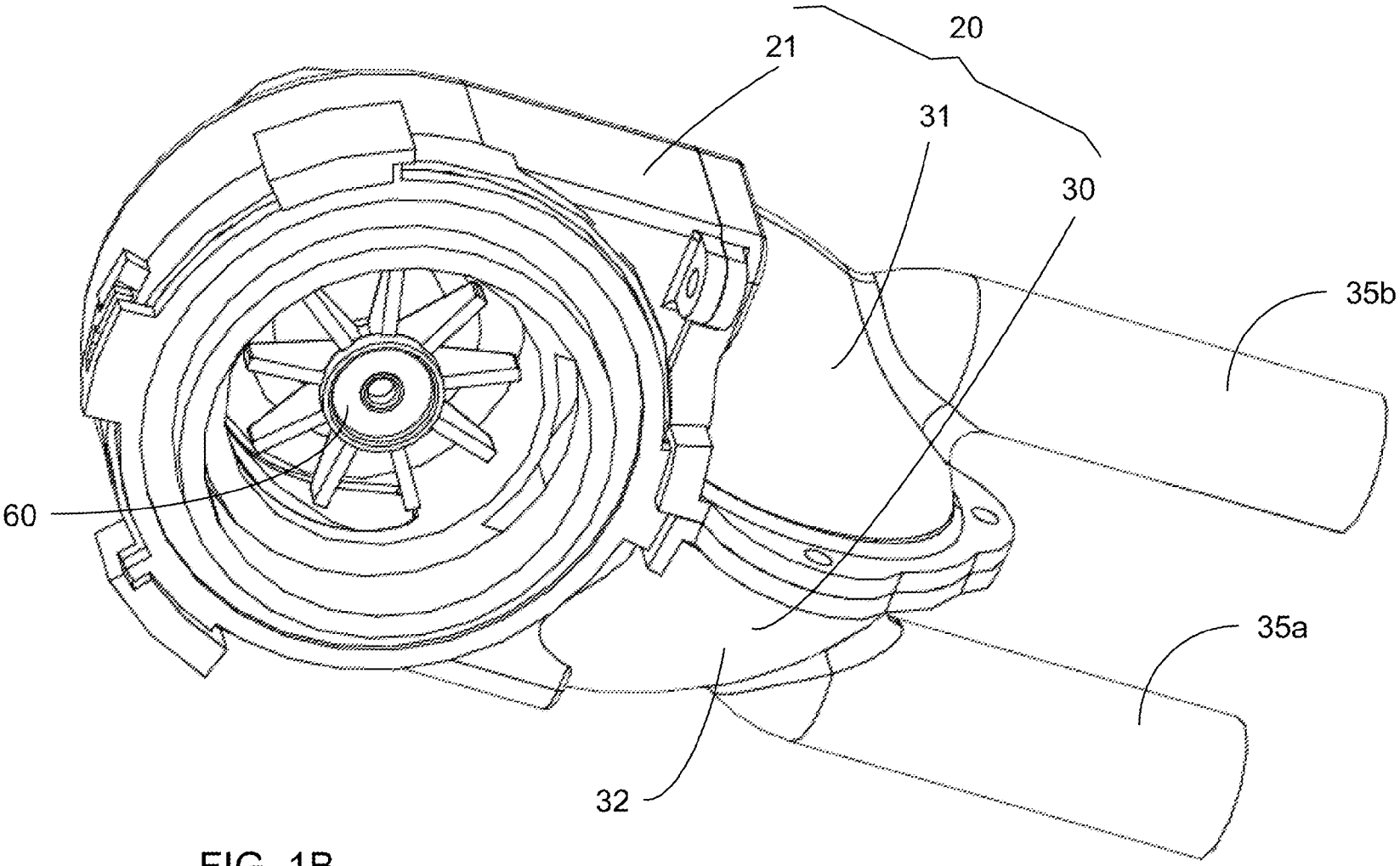
Figure 1C:
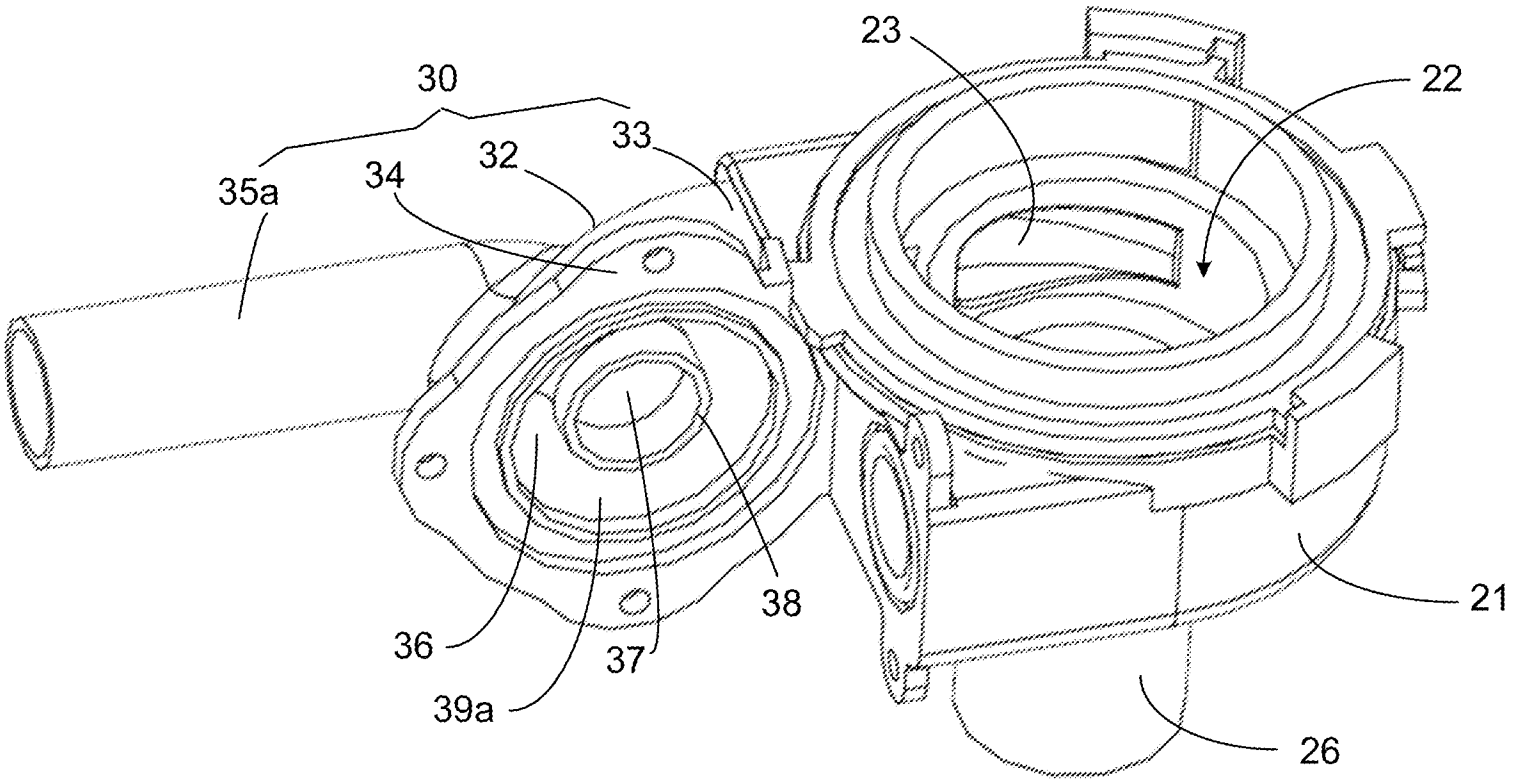
Figure 2:
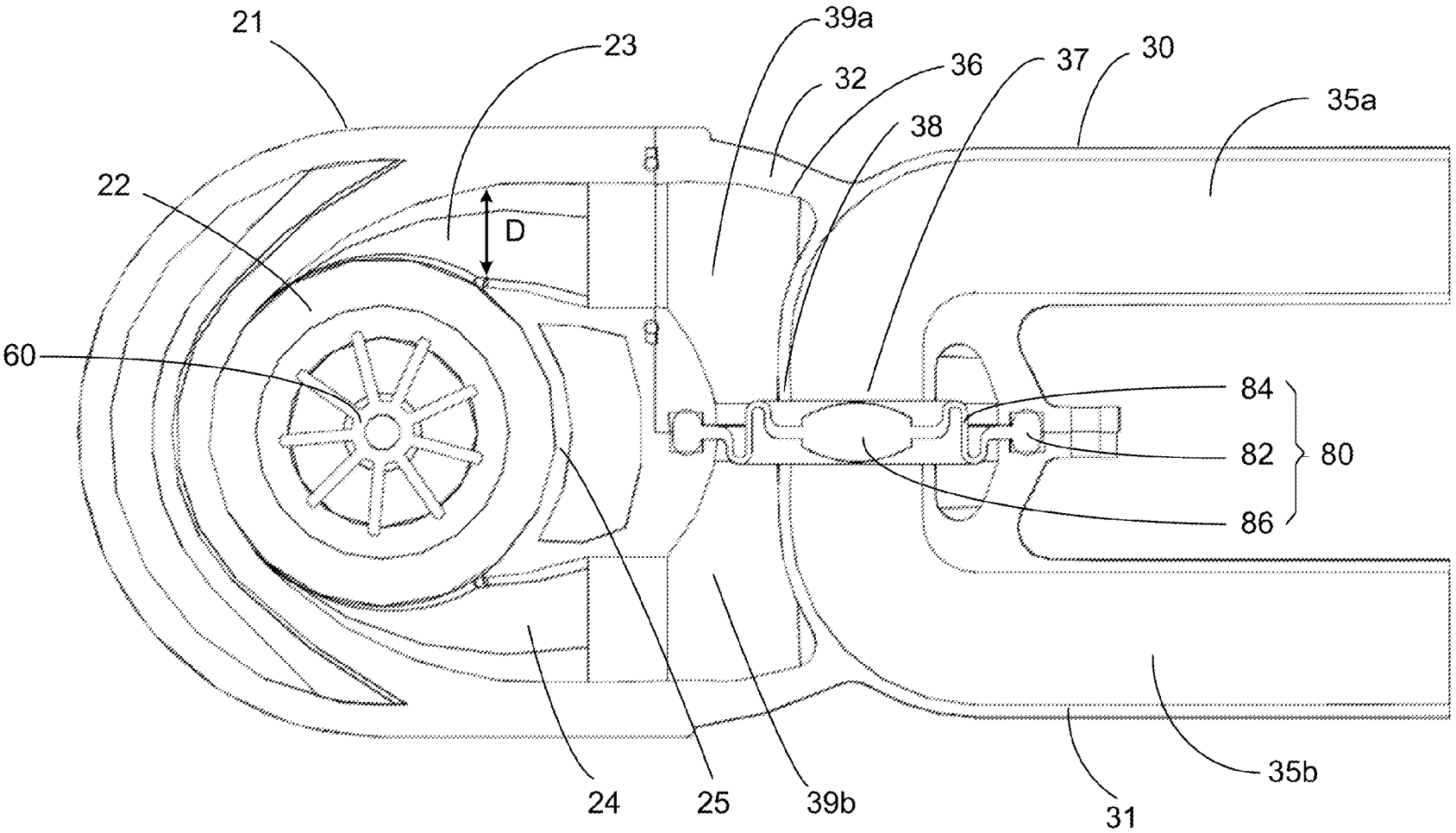
FIG. 2 illustrates a cutaway view of the pump illustrated in FIGS. 1A-1C.

FIGS. 1A-1C illustrate perspective view of a pump 10 in accordance with some embodiments. FIG. 2 illustrates a cutaway view of pump 10, cut along the IV plane (illustrated in FIG. 1A). Pump 10 comprises a housing 20, a motor 40 attached to housing 20, an impeller 60 configured to rotate with motor 40, and a flexible valve 80 accommodated within housing 20. In some embodiments, housing 20 is made of a plastic material.

In some embodiments, motor 40 is fixed to the bottom of housing 20. A sealing ring and/or gasket (not shown) may be used between housing 20 and motor 40, in order to prevent water within housing 20 from entering motor 40. During operation, the rotation of motor 40 drives impeller 60, pushing water that enters pump 10 through an inlet 26 towards pump outlets 35*a* or 35*b*, depending on the direction of rotation of impeller 60.

In some embodiments, housing 20 comprises a main housing 21, a first sub-housing 30, and a second sub-housing 31. Main housing 21 comprises an impeller chamber 22 configured to accommodate impeller 60, a first passage 23, and a second passage 24. First and second passages 23 and 24 are located on opposite sides of impeller chamber 22 and connected to first and second sub-housings 30 and 31, respectively.

Main housing 21 further comprises an inlet 26 connected to impeller chamber 22, allowing for water to enter pump 10 through inlet 26 and be deposited into impeller chamber 22. Main housing 21 may also comprise a stopper 25 located on one side of impeller chamber 22, between first and second passages 23 and 24. Stopper 25 is positioned such that water can flow between the first and second passages 23 and 24 only through the portion of impeller chamber 22 remote from or opposite to stopper 25, thus blocking and preventing water from circulating in impeller chamber 22, which would reduce the efficiency of pump 10.

In the embodiments illustrated in FIGS. 1A-1C and FIG. 2, inlet 26 is connected to the top of impeller chamber 22, positioned in an axial orientation of impeller 60, such that water that enters inlet 26 is instilled into impeller chamber 22. In addition, first and second centrifugal passages 23 and 24 are configured to be substantially perpendicular to the axial direction of impeller 60. First and second passages 23 and 24 have a width D substantially perpendicular to the axial direction of impeller 60 at where they connect to impeller chamber 22. In some embodiments, the widths of first and second passages 23 and 24 increase gradually as passages 23 and 24 extend further away from impeller chamber 22 to improve efficiency of pump 10. It should be understood that the term "substantially," such as in "substantially perpendicular" is used herein to indicate certain features, can refer to either an exact feature (e.g., perfectly perpendicular) or a feature that is slightly offset or otherwise not perfect (e.g., slightly offset from being perfectly perpendicular). In addition, it is understood that other positions and configurations may be used in other embodiments.

First sub-housing 30 comprises a wall 32 defining a first outlet chamber 39*a* and a first outlet pipe 35*a*. In some embodiments, wall 32 is substantially arcuate, such that first outlet chamber 39*a* is in the form of a quarter-sphere, quarter-ellipsoid, or half-dome. First outlet chamber 39*a* has a first connection portion 33 and a second connection portion 34 substantially perpendicular to each other. First connection portion 33 connects to one side of main housing 21, such that an inner surface 36 of wall 32 faces a side of first passage 23 remote from impeller chamber 22. Thus first outlet chamber 39*a* is connected to impeller chamber 22 through first passage 23.

In some embodiments, first outlet pipe 35*a* is configured to pass through wall 32 and extend in the direction of second connecting portion 34. An opening 37 of outlet pipe 35 surrounded by an end wall 38 is positioned close to second connection portion 34.

Second sub-housing 31 is configured similarly to first sub-housing 30, and thus does not need to be separately discussed. Second sub-housing 31 is connected to the other side of main housing 21 from first sub-housing 30, and defines a second outlet chamber 39*b* connected to impeller chamber 22 through second passage 24. First and second outlet chambers 39*a* and 39*b* may together form a hemisphere or dome.

Second sub-housing 31 further comprises a second outlet pipe 35*b* corresponding to first outlet pipe 35*a* of first sub-housing 30. First and second outlet pipes 35*a* and 35*b* form two different paths through which liquid may exit pump 10. For example, in a washing machine, first outlet pipe 35*a* may be in a drainage path, and second outlet pipe 35*b* may be in a recirculation path.

A valve 80 is positioned between first and second sub-housings 30 and 31 and controls whether liquid is able to exit pump 10 through first outlet pipe 35*a* or second outlet pipe 35*b*. When not subject to external force, valve 80 may be configured to be substantially equidistant from opening 37 on first sub-housing 30 and the corresponding opening on second sub-housing 31.

In accordance with some embodiments, first sub-housing 30 is integrally formed with main housing 21, while second sub-housing 31 is a separate component connected to main housing 21 through its first connecting portion and connected to first sub-housing 30 through its second connection portion. This arrangement allows for easy assembly, as well as easy access and replacement of valve 80.

Figure 3A:
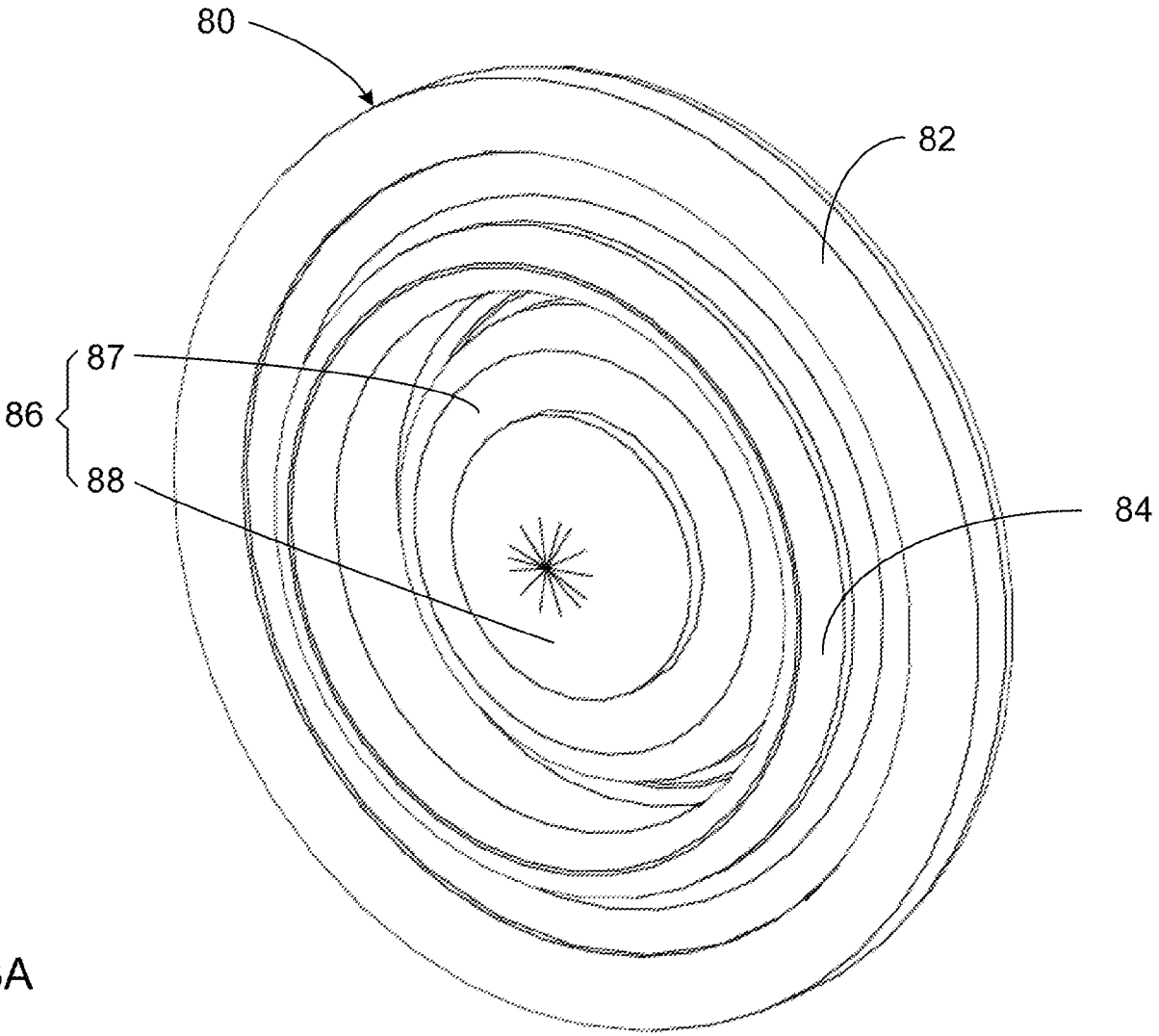
FIGS. 3A and 3B illustrate a valve in accordance with some embodiments.
Figure 3B:
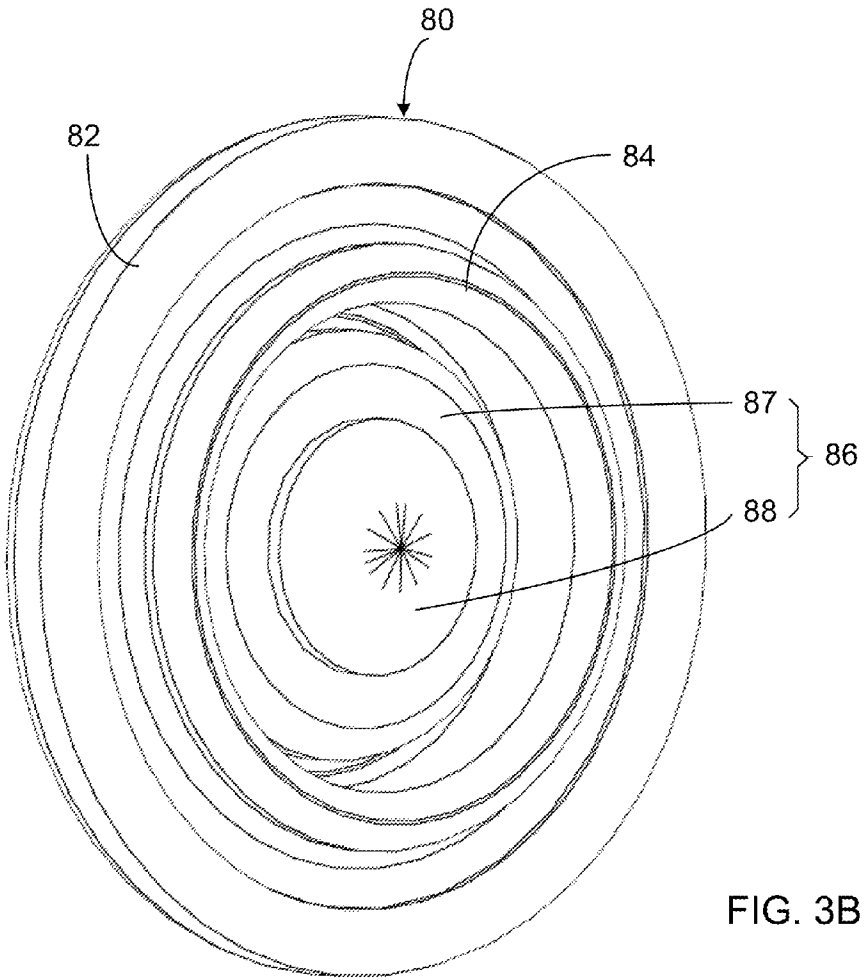

FIGS. 3A and 3B illustrate two opposite sides of valve 80 in accordance with some embodiments. In accordance with the present invention, valve 80 is made of an elastic material, such as, for example, rubber. Valve 80 is positioned in between first outlet pipe 35*a* and second outlet pipe 35*b*, and configured separate first and second outlet chambers 39*a* and 39*b* from each other, and to be able to seal either opening 37 of first outlet pipe 35*a*, or the corresponding opening of second outlet pipe 35*b*. In some embodiments, valve 80 is be substantially disk-shaped, and comprises an outer portion 82, an elastic portion 84, and a central portion 86, wherein outer portion 82 is sandwiched between the second connecting portion 34 of first sub-housing 30 and its corresponding second connecting portion on second sub-housing 31.

Elastic portion 84 may comprise a plurality of creases, wherein the creases are able to be elastically deformed when subject to an external force. Central portion 86 of valve 80 is configured to undergo displacement in response to the deformation of elastic portion 84. When valve 80 is not subject to external force, central portion 86 is distanced from openings 37 of first and second outlet pipes 35*a* and 35*b*.

In some embodiments, central portion 86 of valve 80 comprises a substantially planar holding ring 87 surrounding two protrusions 88, one on each side of valve 80. The outer diameter of holding ring 87 is configured to be equal to or greater than the outer diameter of end wall 38 of first outlet pipe 35*a* and second outlet pipe 35*b*, while the outer diameter of protrusions 88 is configured to be no larger than the inner diameter of end wall 38.

Figure 4A:
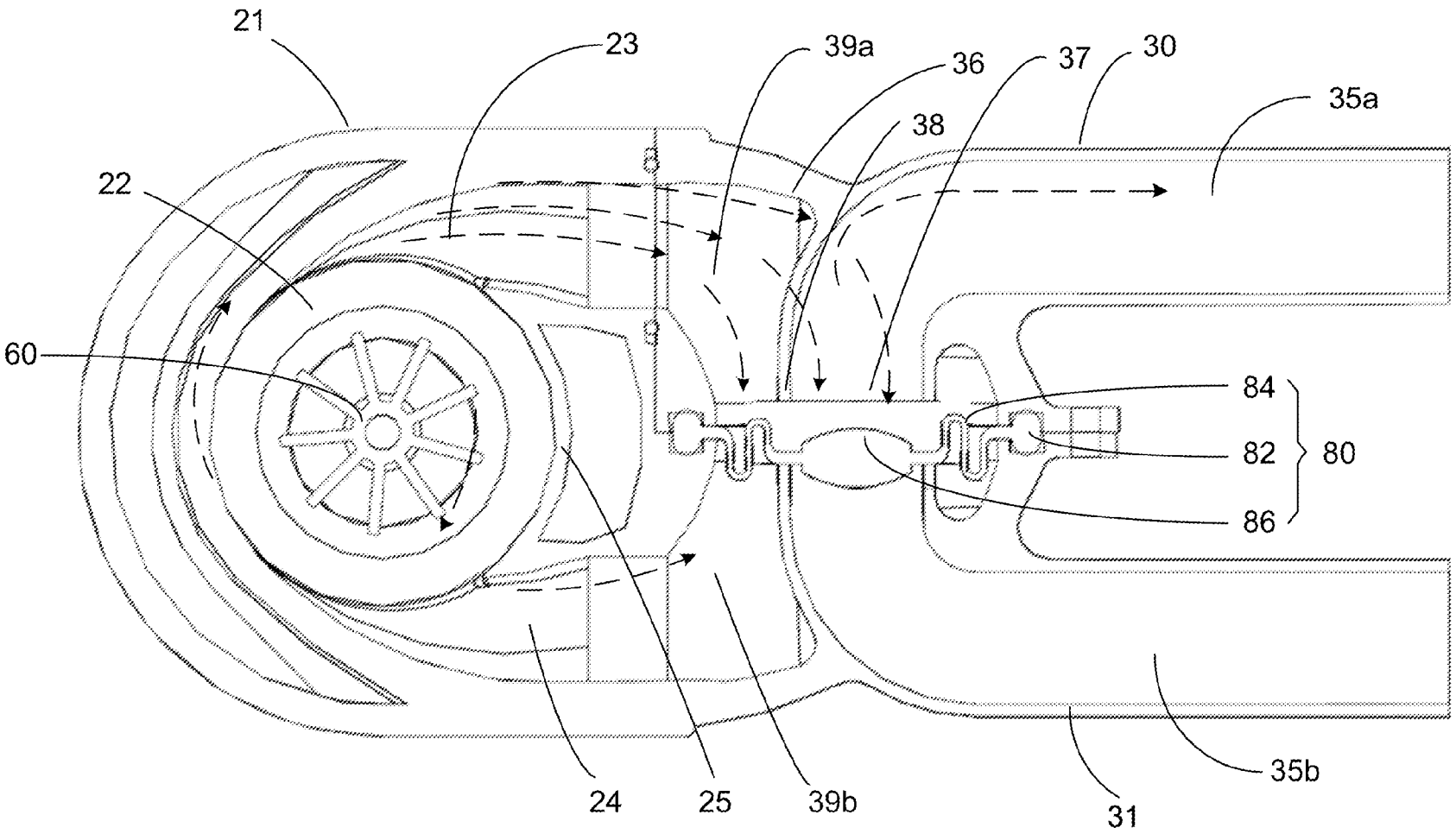
FIGS. 4A and 4B illustrate liquid flow during operation of a pump in accordance with some embodiments.
Figure 4B:
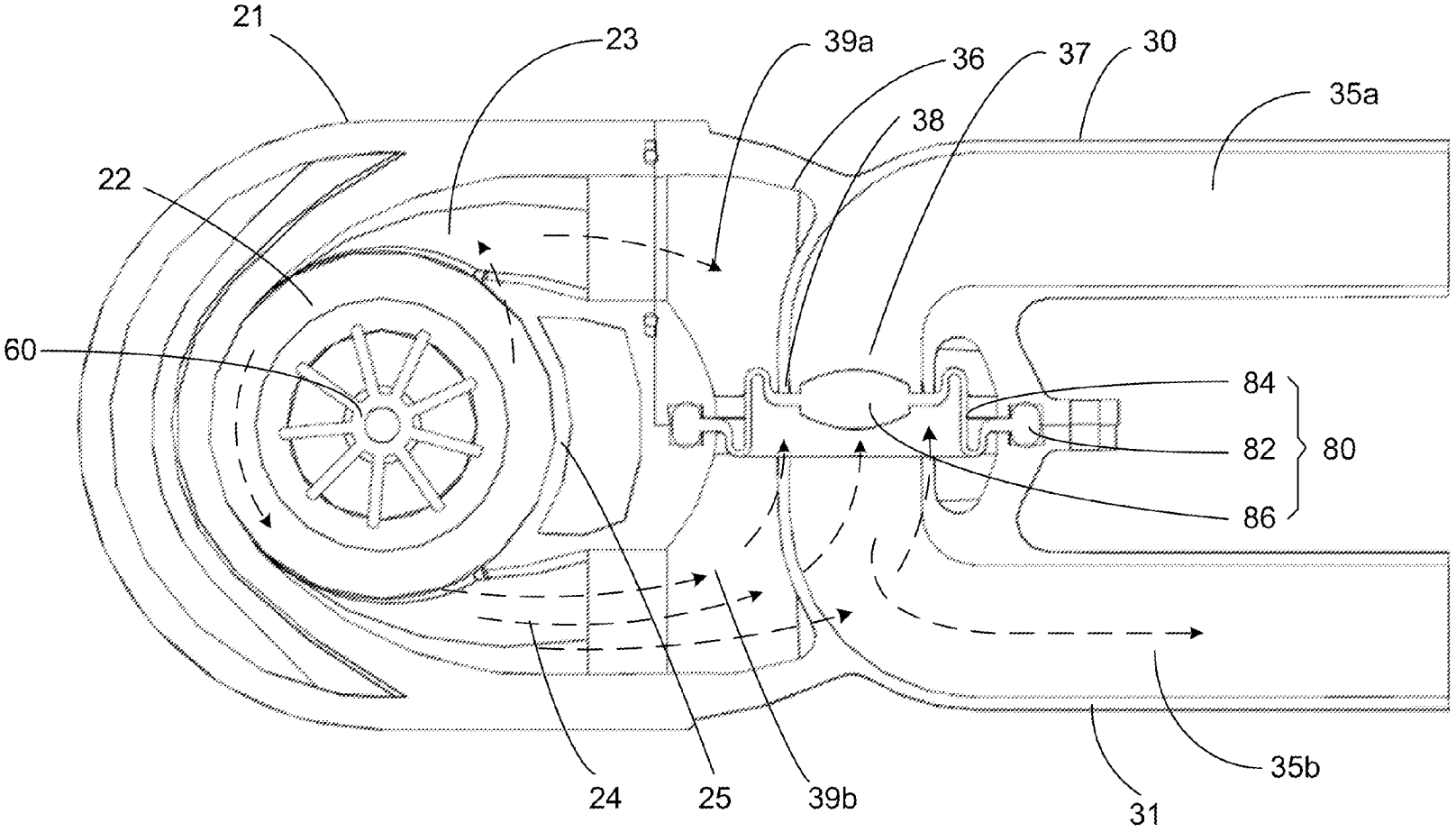

FIGS. 4A and 4B illustrate the flow of liquid within pump 10 during operation in accordance with some embodiments. FIG. 4A illustrates operation when it is desired for water to exit pump 10 through first outlet pipe 35*a* (e.g., for the water drainage mode of the washing machine). To do so, motor 40 spins impeller 60 in a clockwise direction. Centrifugal force causes water entering impeller chamber 22 through inlet 26 to flow towards first outlet chamber 39*a* through first passage 23, where it is further directed towards valve 80 by inner surface 36 of wall 32 of first sub-housing 30. At the same time, a smaller amount of water may have flowed into second outlet chamber 39*b* through second passage 24. Thus a pressure difference between the two sides of valve 80 exists. Greater pressure on the side of first outlet chamber 39*a*, due to the larger amount of water therein, causes elastic portion 84 to deform such that central portion 86 is displaced towards second outlet pipe 35*b* of second sub-housing 31.

As a result, central portion 86 of valve 80 covers the opening of second outlet pipe 35*b*, preventing water from flowing to second outlet pipe 35*b* through second outlet chamber 39*b*. In addition, protrusion 88 may be accommodated within the opening of second outlet pipe 35*b*, aligning holding ring 87 to the end surface of second outlet pipe 35*b*.

At the same time, the distance between central portion 86 of valve 80 and end wall 38 of first sub-housing 30 increases due to the displacement of central portion 86 away from first outlet pipe 35*a*, allowing water within first outlet chamber 39*a* of first sub-housing 30 to flow to first outlet pipe 35*a* through opening 37, where it may flow outside main housing 20 and exit pump 10 (e.g., to the water drainage path of the washing machine).

FIG. 4B illustrates operation when it is desired for water to exit pump 10 through second outlet pipe 35*b* (e.g., for the water recirculation mode of the washing machine), motor 40 rotates impeller 60 in a counter-clockwise direction. Water within impeller chamber 22 is directed through centrifugal force towards second outlet chamber 39*b* through second passage 24, wherein the inner surface of the wall of second sub-housing 31 directs the water towards valve 80. During this time, there will only be a small amount of water in first outlet chamber 39*a*. Thus, the pressure difference on two sides of valve 80 deforms elastic portion 84 and pushes central portion 86 to seal opening 37 of first outlet pipe 35*a*, while water within second sub-housing 31 will be able to flow out of housing 20 through second outlet pipe 35*b*.

Therefore, because the position of valve 80 may be controlled by the direction of rotation of impeller 60, the need for separate control mechanisms for valve 80 is eliminated. In addition, only a single valve 80 is needed, instead of a pair of solenoid valves for selective directing water through first outlet pipe 35*a* or second outlet pipe 35*b*. Thus, the overall cost and complexity of pump 10 is lowered.

Figure 5A:
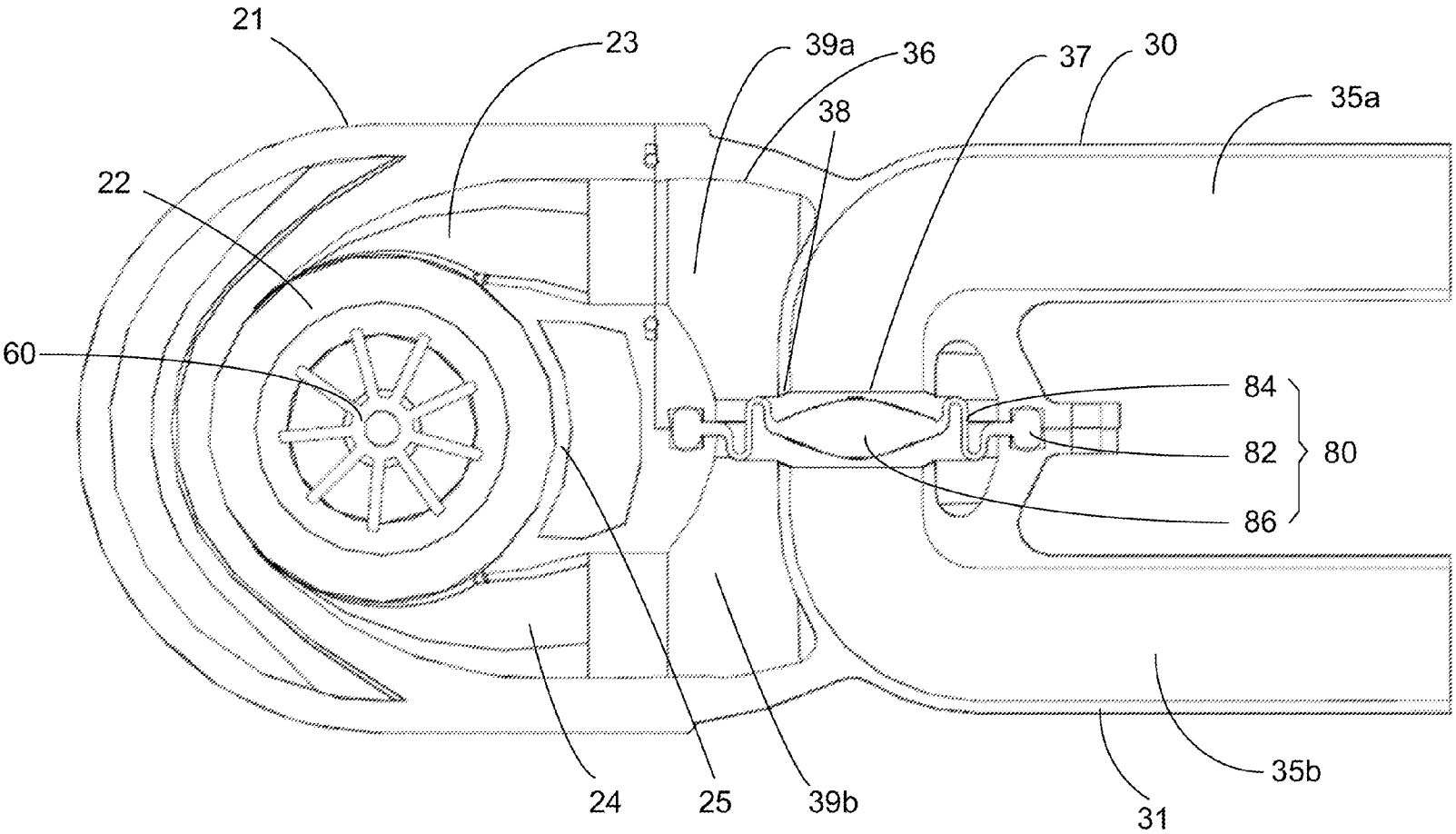
FIGS. 5A and 5B illustrate alternate embodiments of the pump having different valve shapes.
Figure 5B:
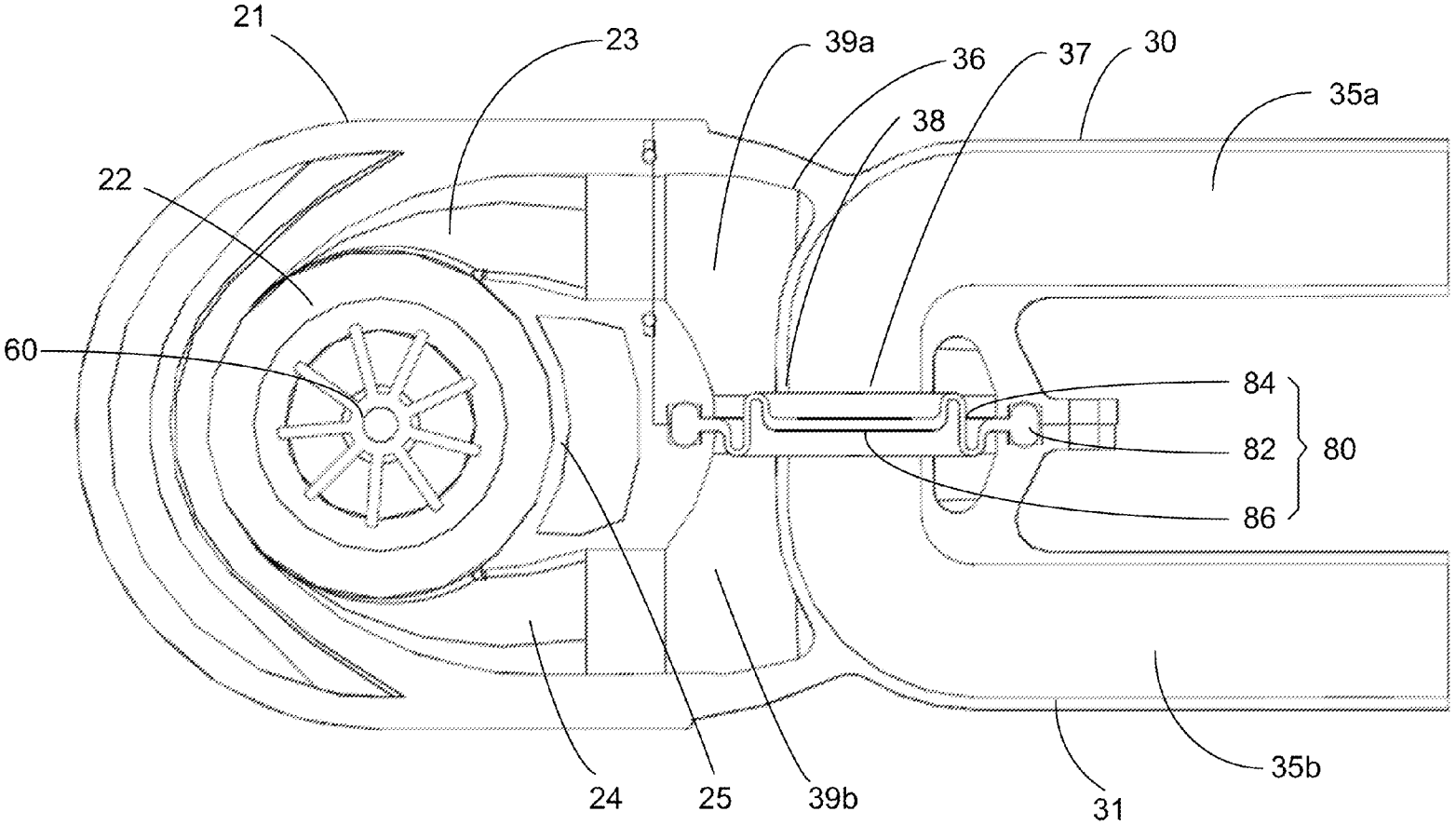

In some embodiments, valve 80 and the openings 37 of first and second outlet pipes 35*a* and 35*b* may take on various shapes, and are not restricted to those illustrated in the figures. For example, central portion 86 of valve 80 may have a convex surface, as illustrated in FIG. 5A, or be substantially planar, as illustrated in FIG. 5B. In some embodiments, end wall 38 of outlet pipes 35 and 35*b* has a corresponding incline to accommodate the shape of central portion 86 in order to accomplish the sealing function.

In the foregoing specification, various aspects have been described with reference to specific embodiments thereof. It will, however, be evident that various modifications and changes may be made thereto without departing from the broader spirit and scope of various embodiments described herein. For example, the above-described systems or modules are described with reference to particular arrangements of components. Nonetheless, the ordering of or spatial relations among many of the described components may be changed without affecting the scope or operation or effectiveness of various embodiments described herein. In addition, although particular features have been shown and described, it will be understood that they are not intended to limit the scope of the claims or the scope of other embodiments, and it will be clear to those skilled in the art that various changes and modifications may be made without departing from the scope of various embodiments described herein. The specification and drawings are, accordingly, to be regarded in an illustrative or explanatory rather than restrictive sense. The described embodiments are thus intended to cover alternatives, modifications, and equivalents.

The invention claimed is:

1. A pump, comprising:

a centrifugal impeller;

an impeller chamber housing the centrifugal impeller;

an inlet pipe communicating with the impeller chamber;

a first passageway communicating with the impeller chamber at a first side of the impeller chamber;

a second passageway communicating with the impeller chamber at a second side of the impeller chamber remote from the first side of the impeller chamber;

a first outlet chamber connected to the first passageway;

a second outlet chamber opposite to the first outlet chamber and connected to the second passageway;

a first outlet having an opening defined in an end wall of the first outlet and communicating with the first outlet chamber;

a second outlet having an opening defined in an end wall of the second outlet and communicating with the second outlet chamber; and a valve disposed between the first and second outlet chambers and adjacent to the openings of the first outlet and the second outlet, wherein:

the centrifugal impeller is configured to rotate in a first direction to pump liquid from the impeller chamber substantially to the first passageway to elastically deform the valve in a first direction, thereby controlling a flow of liquid through the first outlet; and the centrifugal impeller is configured to rotate in a second direction opposite to the first direction to pump liquid from the impeller chamber substantially to the second passageway to elastically deform the valve in a second direction opposite to the first direction, thereby controlling a flow of liquid through the second outlet, wherein the valve comprises:

an outer ring disposed between the first and second outlet chambers;

a central portion configured to cover the second outlet in response to the valve elastically deforming in the first direction, and cover the first outlet in response to the valve elastically deforming in the second direction; and an elastic ring between the outer ring and the central portion;

wherein:

the central portion of the valve comprises a holding ring connected to the elastic ring, and two central protrusions located on opposites sides of the holding ring, respectively facing the openings of the first and second outlets;

the holding ring is planar and has a diameter greater than a diameter of the opening of the first or second outlet;

the holding ring abuts against the end wall of the first outlet together with one of the two protrusions fitted within the opening of the first outlet in response to the centrifugal impeller rotating in the second direction, and the holding ring abuts against the end wall of the second outlet together with the other one of the two protrusions fitted within the opening of the second outlet in response to the centrifugal impeller rotating in the first direction.

2. The pump of claim 1, wherein the first and second passageways are on opposite sides of the impeller chamber.

3. The pump of claim 1, wherein:

the valve is elastically deformed in the first direction to make the when the amount of liquid flowing through the first passageway exceeds the amount of liquid flowing through the second passageway; and the valve is elastically deformed in the second direction when the amount of liquid flowing through the second passageway exceeds the amount of liquid flowing through the first passageway.

4. The pump of claim 1, wherein the valve prevents flow of liquid between the first and second outlet chambers.

5. The pump of claim 1, wherein the first and second outlet chambers form a dome shape.

6. The pump of claim 5, wherein a cross-sectional width of the first and second passageways gradually increases between the impeller chamber and the dome.

7. A pump comprising:

a motor;

an impeller driven by the motor;

a housing fixed to the motor, comprising:

an impeller chamber housing the impeller;

an inlet pipe communicating with the impeller chamber;

a first outlet chamber communicating with the impeller chamber at a first side of the impeller chamber; and a second outlet chamber communicating with the impeller chamber at a second side of the impeller chamber opposite to the first side;

a first outlet having an opening defined in an end wall of the first outlet and communicating with the first outlet chamber;

a second outlet having an opening defined in an end wall of the second outlet and communicating with the second outlet chamber; and a valve positioned between the first and second outlet chambers, and comprising an elastic portion and a central portion;

wherein:

an amount of liquid in the first outlet chamber relative to an amount of liquid in the second outlet chamber is based at least in part upon a direction of rotation of the impeller;

the elastic portion of the valve causes the central portion of the valve to undergo a linear displacement based at least in part upon the amount of liquid in the first outlet chamber relative to the amount of liquid in the second outlet chamber; and a flow of liquid through the first and second outlets is based at least in part upon the displacement of the central portion of the valve;

wherein:

the central portion of the valve comprises a holding ring connected to the elastic ring and two central protrusions located on opposites sides of the holding ring, respectively facing the openings of the first and second outlets;

the holding ring is planar and has a diameter greater than a diameter of an opening of the first or second outlet;

the holding ring is configured to abut against the end wall of the first or second outlet together with one of the two central protrusions fitting within the opening of the first or second outlet when the central portion is displaced.

8. The pump of claim 7, wherein the valve prevents flow of liquid between the first and second outlet chambers.

9. The pump of claim 7, further comprising:

a first centrifugal passage connecting the first outlet chamber to the first side of the impeller chamber; and a second centrifugal passage connecting the second outlet chamber to the second side of the impeller chamber;

wherein a cross-sectional width of the first and second centrifugal passageways gradually increases between the impeller chamber and the first and second outlet chambers.

10. The pump of claim 7, wherein:

the impeller is configured to rotate in a first direction to pump liquid from the impeller chamber substantially to the first outlet chamber; and the impeller is configured to rotate in a second direction to pump pumps liquid from the impeller chamber substantially to the second outlet chamber.

11. The pump of claim 7, wherein:

a greater amount of liquid in the first outlet chamber than in the second outlet chamber causes a displacement of the central portion of the valve, thereby restricting flow of liquid through the second outlet; and a greater amount of liquid in the second outlet chamber than in the first outlet chamber causes a displacement of the central portion of the valve, thereby restricting flow of liquid through the first outlet.

12. The pump of claim 7, wherein the valve is located adjacent to the opening of the first outlet and the opening of the second outlet, and a distance between the valve and the opening of the first outlet is less than or equal to a range of displacement of the central portion.

13. The pump of claim 7, wherein the first outlet chamber and the second outlet chamber are substantially quarter-sphere shaped.

14. A method for selectively pumping liquid to one of two outlets, comprising:

providing an impeller chamber housing a centrifugal impeller;

providing a first passage from a first side of the impeller chamber to a first side of a dome;

providing a second passage from a second side of the impeller chamber to a second side of the dome;

connecting a first outlet to the first side of the dome;

connecting a second outlet to the second side of the dome;

rotating the impeller in a first direction to drive liquid substantially through the first passage;

providing a valve with an outer portion retained between the first and second sides of the dome, a central portion comprising a planar holding ring and a central protrusion, and an elastic portion connected to the outer portion and the central portion; and moving the central portion in a first direction with an elastic deformation of the elastic portion to make the holding ring abut against an end wall of the second outlet together with the central protrusion fitting within the second outlet in response to the liquid flowing through the first passage, thereby pumping liquid to the first outlet.

15. The method of claim 14, further comprising:

rotating the impeller in a second direction opposite to the first direction to drive liquid substantially through the second passage; and elastically deforming the valve in a second direction opposite to the first direction to block the first outlet in response to the liquid flowing through the second passage, thereby pumping liquid to the second outlet.

16. The method of claim 14, wherein the valve is elastically deformed in the first direction in response to a greater amount of liquid in the first side of the dome than in the second side of the dome.

17. The method of claim 14, further comprises providing the valve such that it prevents liquid flow between the first and second sides of the dome.

* * * * *